US006308782B1

(12) United States Patent
Brooks et al.

(10) Patent No.: US 6,308,782 B1
(45) **Date of Patent: *Oct. 30, 2001**

(54) METHOD AND APPARATUS FOR ONE-TRIP INSERTION AND RETRIEVAL OF A TOOL AND AUXILIARY DEVICE

(75) Inventors: Robert T. Brooks, Grand Prairie; Dan P. Saurer, Richardson, both of TX (US)

(73) Assignee: Halliburton Energy Services, Inc, Dallas, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/240,290

(22) Filed: Jan. 29, 1999

Related U.S. Application Data

(60) Provisional application No. 60/073,153, filed on Jan. 30, 1998.

(51) Int. Cl.[7] ..... E21B 23/00

(52) U.S. Cl. ..... 166/313; 166/50; 166/117.6

(58) Field of Search ..... 166/313, 50, 117.6, 166/117.5; 175/80, 81, 82, 79

(56) References Cited

U.S. PATENT DOCUMENTS

| | | | | |
|---|---|---|---|---|
| 2,170,284 | * | 8/1939 | Eastman | 175/82 |
| 2,397,070 | | 3/1946 | Zublin | 166/4 |

(List continued on next page.)

FOREIGN PATENT DOCUMENTS

| | | |
|---|---|---|
| 0 701 040 A2 | 3/1996 | (EP) . |
| 2 297 988 A | 8/1996 | (GB) . |
| WO 95/23274 | 8/1995 | (WO) . |
| WO97/07318 | 2/1997 | (WO) . |
| WO 98/09047 | 3/1998 | (WO) . |

OTHER PUBLICATIONS

Written opinion for PCT Application No. PCT/US99/02098.

PCT Advertisement Thru Tubing Multi Lateral Re–Entry System (MLR™)—one page, 1995®.

Great Britain Journal of Patents, Nov. 13, 1996, *Official Journal* (*Patents*)—one page.

Schlumberger Horizontal Well—Complete Analysis: Production Logging, DEFT Specifications, Mar. 10, 1997 (2 pages).

PCT International Search Report for Int'l Application PCT/US98/06603 filed Jul. 29, 1998.

PCT International Search Report for Int'l Application PCT/US98/06653 filed Apr. 3, 1998.

PCT International Search Report for Int'l Application PCT/US98/06658 filed Apr. 3, 1998.

Inpadoc/Fam. & Legal Stat. 1998 Report (five pages).

*Primary Examiner*—Hoang Dang
(74) *Attorney, Agent, or Firm*—William M. Imwalle; Marlin R. Smith

(57) ABSTRACT

A multi-lateral well has a casing, and has lateral wellbores which communicate with the casing through respective windows. A tool at the end of a coiled tubing string is introduced into the well, while disposed in a tool receiving recess of an auxiliary member that is releasably coupled against upward movement relative to the tool. At a selected vertical position within the casing, the auxiliary member is secured against further downward movement, and the releasable coupling is then interrupted to permit the tubing string to move downwardly with respect to the auxiliary member. The auxiliary member may have an inclined surface to deflect the tool into a lateral wellbore. When use of the tool is completed, the tubing string with the tool thereon is moved upwardly, and an arrangement is provided to limit upward movement of the tool relative to the auxiliary member, so that the tool and the auxiliary member are simultaneously withdrawn from the well.

18 Claims, 14 Drawing Sheets

U.S. PATENT DOCUMENTS

| | | | | |
|---|---|---|---|---|
| 2,555,462 | * | 6/1951 | Beck | 166/82 |
| 2,797,893 | | 7/1957 | McCune et al. | 255/1.6 |
| 2,804,926 | | 9/1957 | Zublin | 166/50 |
| 2,858,107 | | 10/1958 | Colmerauer | 255/1.6 |
| 3,339,636 | | 9/1967 | Frisby . | |
| 4,420,049 | | 12/1983 | Holbert | 175/45 |
| 4,848,820 | | 7/1989 | Morrell | 294/86.18 |
| 4,928,767 | | 5/1990 | Jelsma | 166/377 |
| 5,012,877 | * | 5/1991 | Winters et al. | 175/80 |
| 5,222,554 | | 6/1993 | Blount et al. | 166/117.6 |
| 5,311,936 | | 5/1994 | McNair et al. | 166/50 |
| 5,318,121 | | 6/1994 | Brockman et al. | 166/313 |
| 5,325,924 | | 7/1994 | Bangert et al. | 166/313 |
| 5,388,648 | | 2/1995 | Jordan, Jr. | 166/380 |
| 5,425,419 | | 6/1995 | Sieber | 166/206 |
| 5,427,177 | | 6/1995 | Jordan, Jr. et al. | 166/50 |
| 5,427,179 | | 6/1995 | Bailey et al. | 166/117.6 |
| 5,431,219 | | 7/1995 | Leising et al. | 166/50 |
| 5,458,209 | * | 10/1995 | Hayes et al. | 175/61 |
| 5,467,819 | | 11/1995 | Braddick | 166/117.6 |
| 5,474,126 | * | 12/1995 | Lynde et al. | 166/117.6 |
| 5,474,131 | | 12/1995 | Jordan, Jr. et al. | 166/313 |
| 5,477,925 | | 12/1995 | Trahan et al. | 166/382 |
| 5,484,017 | | 1/1996 | Coon | 166/117.5 |
| 5,520,252 | | 5/1996 | McNair | 166/313 |
| 5,533,573 | | 7/1996 | Jordan, Jr. et al. | 166/313 |
| 5,535,822 | | 7/1996 | Schock et al. | 166/50 |
| 5,564,503 | | 10/1996 | Longbottom et al. | 166/313 |
| 5,615,740 | * | 4/1997 | Comeau et al. | 166/380 |
| 5,649,595 | | 7/1997 | Davis et al. | 166/297 |
| 5,651,415 | | 7/1997 | Scales | 166/250 |
| 5,678,634 | | 10/1997 | Rehbock et al. | 166/377 |
| 5,697,445 | | 12/1997 | Graham | 166/313 |
| 5,704,437 | | 1/1998 | Murray | 175/61 |
| 5,715,891 | | 2/1998 | Graham | 166/313 |
| 5,730,224 | | 3/1998 | Williamson et al. | 166/386 |
| 5,740,864 | * | 4/1998 | De Hoedt et al. | 166/387 |
| 5,787,987 | | 8/1998 | Forsyth et al. | 166/313 |
| 5,806,614 | | 9/1998 | Nelson | 175/61 |
| 6,003,621 | * | 12/1999 | Murray | 175/79 |

* cited by examiner

FIG. 2A
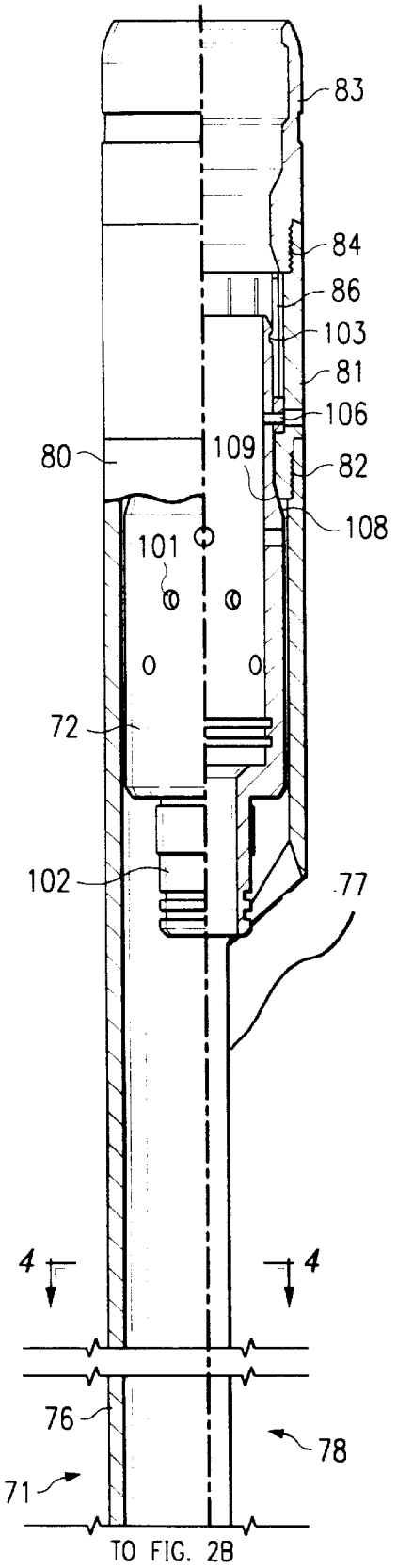
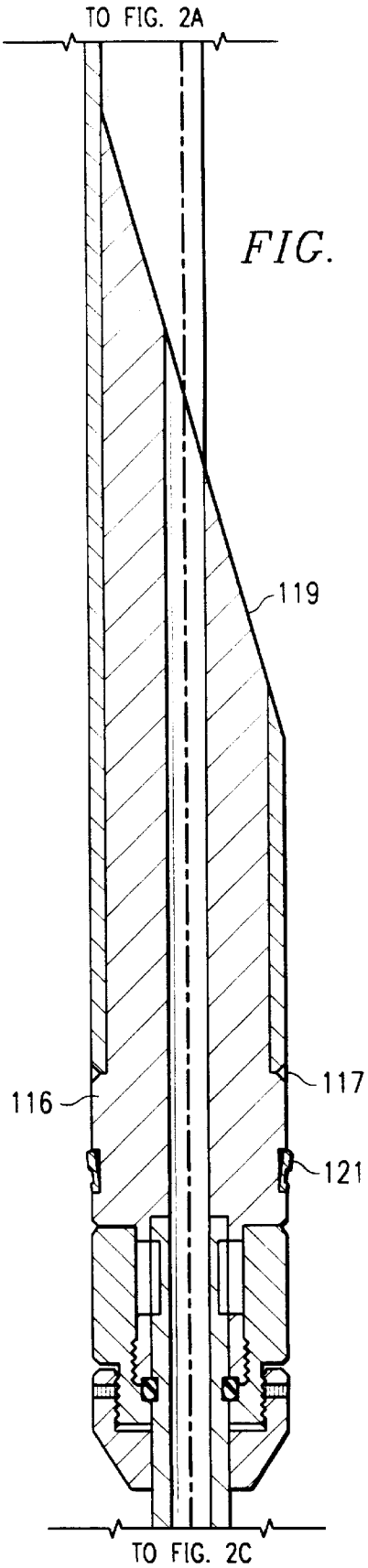
FIG. 2B

METHOD AND APPARATUS FOR ONE-TRIP INSERTION AND RETRIEVAL OF A TOOL AND AUXILIARY DEVICE

RELATED APPLICATIONS

This application claims the benefit of U.S. Provisional Application Ser. No. 60/073,153, filed Jan. 30, 1998.

This application is related to copending U.S. patent application Ser. No. 09/240,370, filed Jan. 29, 1999, entitled "Method and Apparatus for Running Two Tubing Strings into a Well".

TECHNICAL FIELD OF THE INVENTION

This invention relates in general to equipment for multilateral wells and, more particularly, to a method and apparatus for a one-trip insertion and retrieval of a tool and an auxiliary device.

BACKGROUND OF THE INVENTION

Multi-lateral wells have a vertical bore with two or more lateral windows therealong, each window communicating with a respective lateral bore. In order to access a lateral bore, it is typically necessary to run a coiled tubing string into the well three times.

For example, in order to direct a tool into a selected lateral bore, the coiled tubing string is run into the well with a whipstock thereon, and the whipstock is then fixed at the lower end of the window for the selected lateral bore. Then, the tubing string is withdrawn, leaving the whipstock in place. Thereafter, the coiled tubing string is run into the well a second time, with the appropriate tool at the end of the tubing string. When the tool reaches the whipstock, the whipstock deflects the tool out into the selected lateral bore. When use of the tool is completed, the coiled tubing string is withdrawn again in order to remove the tool from the well. Subsequently, the coiled tubing string is run into the well a third time, with a retrieving device which can engage a fishing neck provided on the whipstock. Then, the coiled tubing string is withdrawn from the well, in order to retrieve the whipstock out of the well.

During this three-trip procedure, the coiled tubing string is uncoiled three times for respective insertions, and is coiled back up three times during respective withdrawals. Coiling and uncoiling the tubing string contributes to fatigue and ultimate failure of the tubing string, which is relatively expensive. Thus, it is highly desirable to reduce the number of insertions or trips of the coiled tubing string into the well in order to perform any desired operation, including insertion and retrieval of a tool from a lateral bore.

SUMMARY OF THE INVENTION

From the foregoing, it may be appreciated that a need has arisen for a method and apparatus for facilitating access to a multi-lateral well with a minimum number of insertions of a coiled tubing string. According to the present invention, a method and apparatus are provided to address this need.

One form of the present invention involves: supporting an auxiliary member for vertical movement within a vertical well casing; supporting an elongate tubing string for vertical movement within the vertical casing independently of the auxiliary member; providing a tool at a lower end of the tubing string; effecting downward movement of the tubing string while preventing downward movement of the tubing string away from an insertion position relative to the auxiliary member; preventing downward movement of the auxiliary member past a selected position within the vertical casing; and thereafter effecting continued downward movement of the tubing string while permitting the tubing string to move downwardly away from the insertion position relative to the auxiliary member.

A different form of the present invention involves: releasably holding a vertically moveable auxiliary member against vertical movement relative to the vertical casing; supporting an elongate tubing string for vertical movement within the vertical casing independently of the auxiliary member, the tubing string extending downwardly past the auxiliary member; providing a tool at a lower end of the tubing string; effecting upward movement of the tubing string; preventing upward movement of the tubing string past a withdrawal position relative to the auxiliary member; and permitting upward movement of the auxiliary member with the tubing string after the tubing string reaches the withdrawal position.

BRIEF DESCRIPTION OF THE DRAWINGS

A better understanding of the present invention will be realized from the detailed description which follows, taken in conjunction with the accompanying drawings, in which:

FIGS. 2A–2D are respective portions of a diagrammatic cutaway side view of an auxiliary member and dimple connector, and are referred to collectively hereinafter as FIG. 2;

DETAILED DESCRIPTION OF THE INVENTION

The preferred embodiments of the present invention and its advantages are best understood by referring now in more detail to FIGS. 1–9 of the drawings, in which like numerals refer to like parts.

Figure 1A:
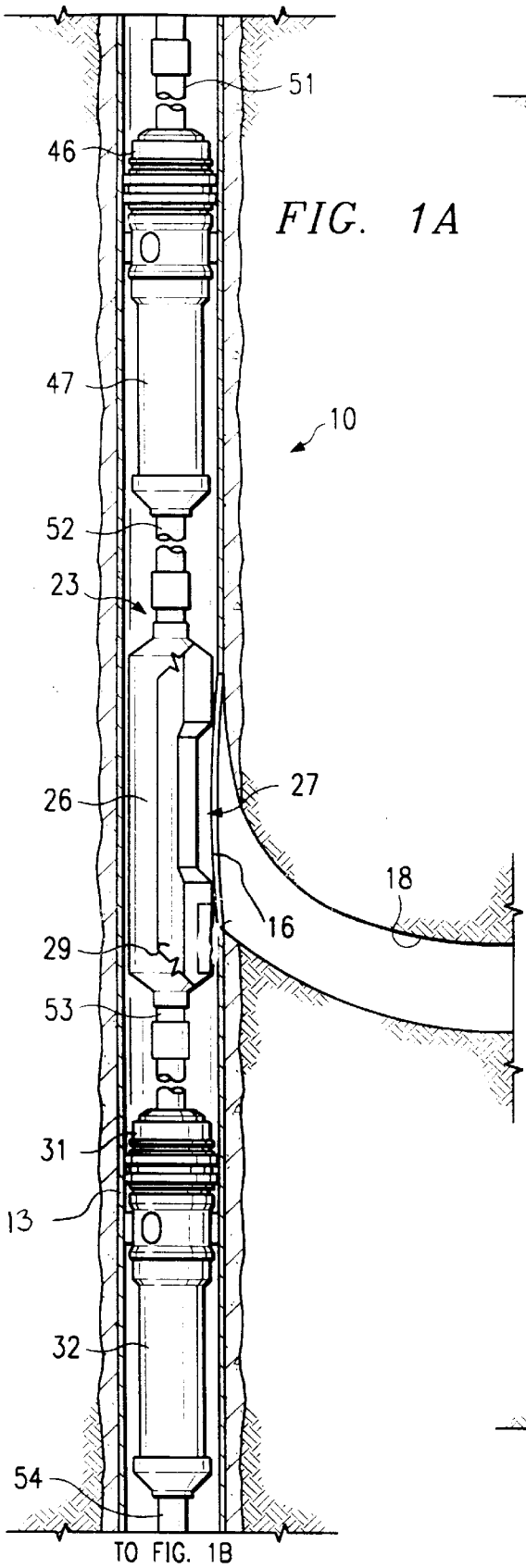
FIGS. 1A and 1B are respective portions of a diagrammatic cutaway side view of a multilateral well, and are referred to collectively herein as FIG. 1.
Figure 1B:
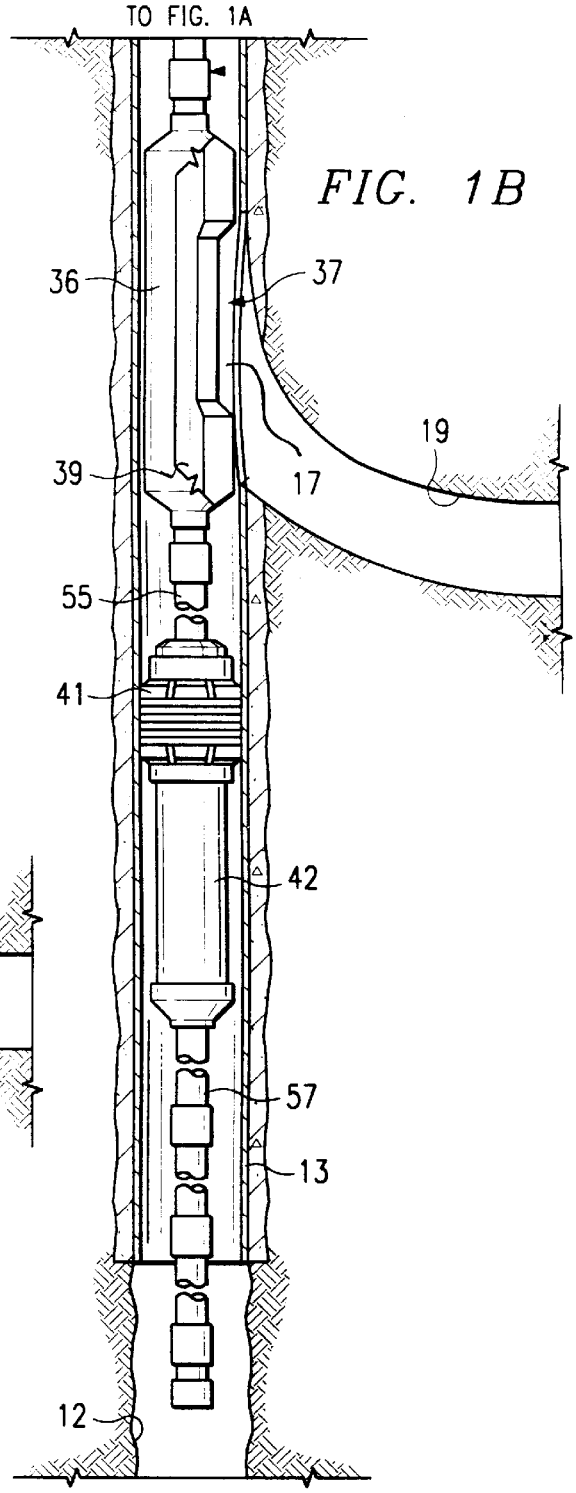

FIGS. 1A and 1B, which are collectively referred to herein as FIG. 1, are respective portions of a diagrammatic sectional side view of a multilateral well 10. The disclosed well 10 is intended for the production of hydrocarbons, but the invention may also be used with other types of wells.

The well 10 includes a vertical bore 12, a portion of which is shown at the lower end of the well. A cylindrical tubular metal outer casing 13 is disposed within the vertical bore 12. The outer casing 13 in the disclosed embodiment has an inside diameter of approximately six inches, but the present invention is not restricted to any particular casing size.

The casing 13 has a lateral opening or window 16 milled in one side thereof, at a location vertically between the upper and lower ends of the casing 13. The casing 13 has a further window 17 milled through one side thereof at a location between the window 16 and the lower end of the casing 13. The well 10 includes a lateral bore 18 which communicates at one end with the window 16, and a further lateral bore 19 which communicates at one end with the window 17. Each of the lateral bores 18 and 19 may have cemented therein a not-illustrated tubular metal casing. For convenience, the windows 16 and 17 are both shown in FIG. 1 as being disposed on the same side of the vertical casing 13, but it will be recognized that they may be angularly offset with respect to each other. If the windows 16 and 17 are angularly offset, then the lateral bores 18 and 19 will also be angularly offset with respect to each other.

Although the term vertical is used herein to refer to the primary bore 12, and the term lateral is used to refer to the secondary bores 18 and 19, it will be recognized that these bores could have an orientation other than that in which the primary bore is vertical, for example where the well has been drilled at an angle pursuant to slant drilling techniques. The present invention is suitable for use with multilateral wells in which the orientation of the bores is different from that shown in FIG. 1.

The outer casing 13 has, extending through most of the length thereof, an inner casing which is designated generally with reference numeral 23. The inner casing 23 may also be referred to as production tubing. The inner casing 23 includes a tubing lateral access window system 26, which is vertically aligned with the window 16 in the casing 13. The tubing lateral access window system 26 has in one side thereof a window 27, which is vertically and rotationally aligned with the window 16. An alignment latch 29 is provided at the inside lower end of the window system 26. A seal bore packer 31 is disposed in the casing 13 below the window 16 and the window system 26, and a long seal bore extension 32 extends downwardly from the seal bore packer 31.

Below the seal bore packer 31, the inner casing 23 includes a further tubing lateral access window system 36, which is vertically aligned with the window 17 in the casing 13, and which has in one side thereof a window 37 that is rotationally and vertically aligned with the window 17 in the casing 13. An alignment latch 39 is provided at the inside lower end of the window system 36. Below the window 17 and the window system 36, a seal bore packer 41 is provided in the outer casing 13, and a long seal bore extension 42 extends downwardly from the seal bore packer 41.

A seal bore packer 46 is provided within the outer casing 13 above the tubing lateral access window system 26, and has a long seal bore extension 47 extending downwardly therefrom. The seal bore packer 46 and seal bore extension 47 are disposed vertically higher than the window 16. The inner casing 23 also includes respective vertical tubing sections 51–55, which extend between the various major components of the inner casing that have been discussed above. In addition, a tubing section or tailpipe 57 extends downwardly from the lower end of the long seal bore extension 42.

Figure 2C:
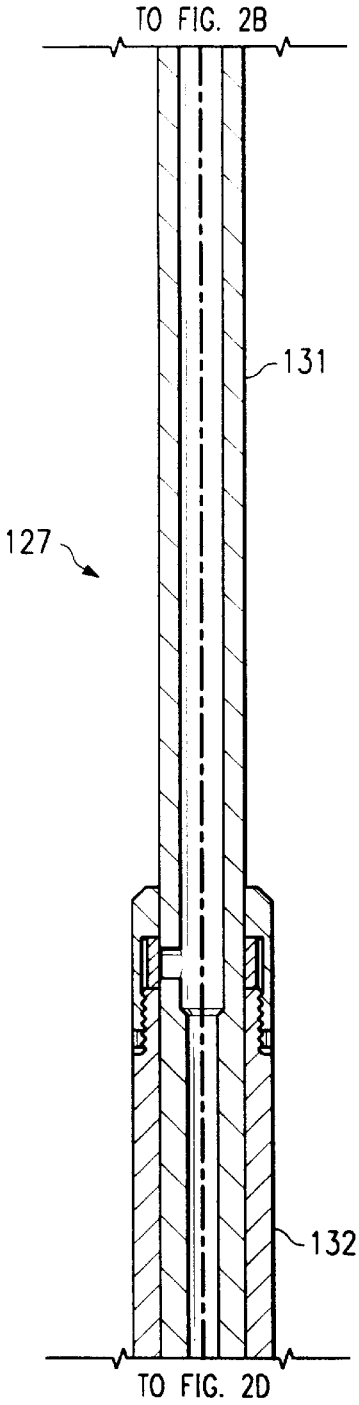
Figure 2D:
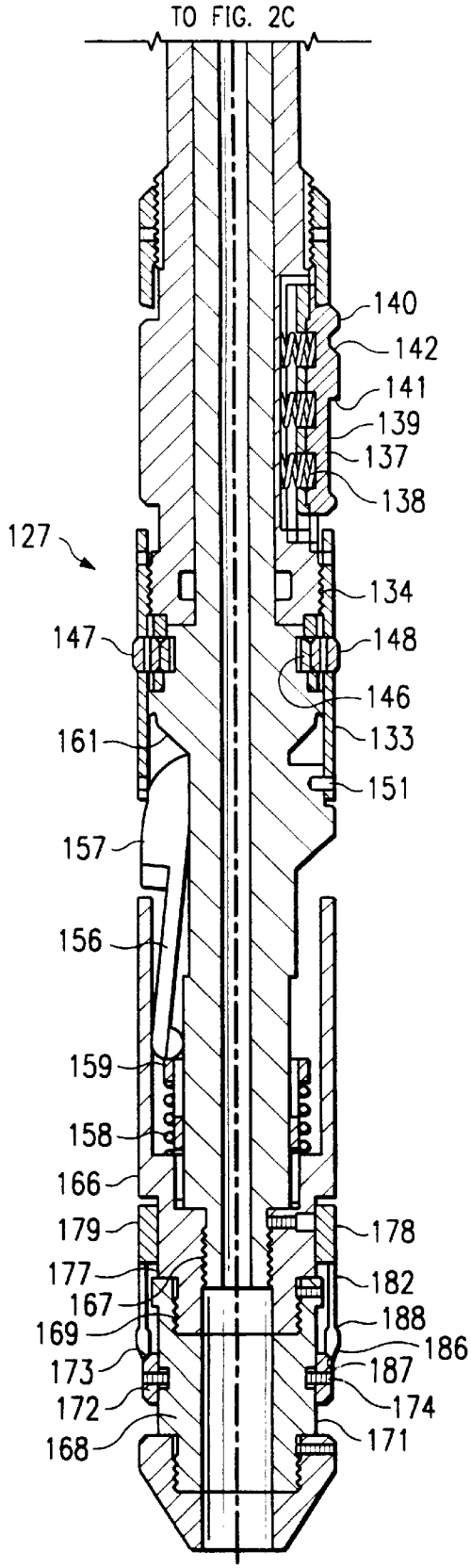
Figure 3A:
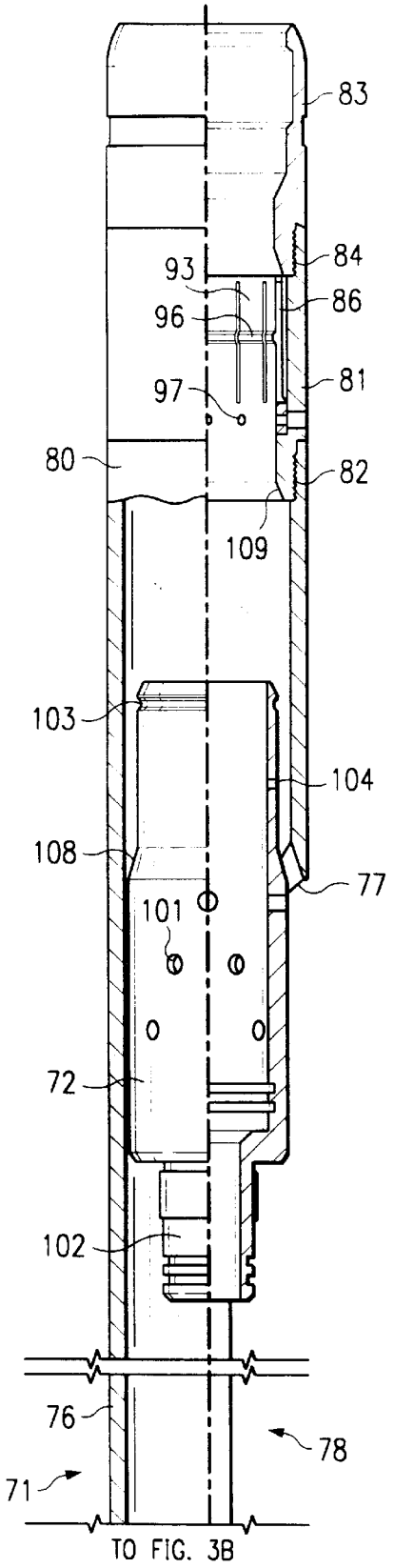
FIGS. 3A–3D are diagrammatic views similar to FIGS. 2A–2D, but show a different operational position of the illustrated structure, and are collectively referred to herein as FIG. 3.
Figure 3B:
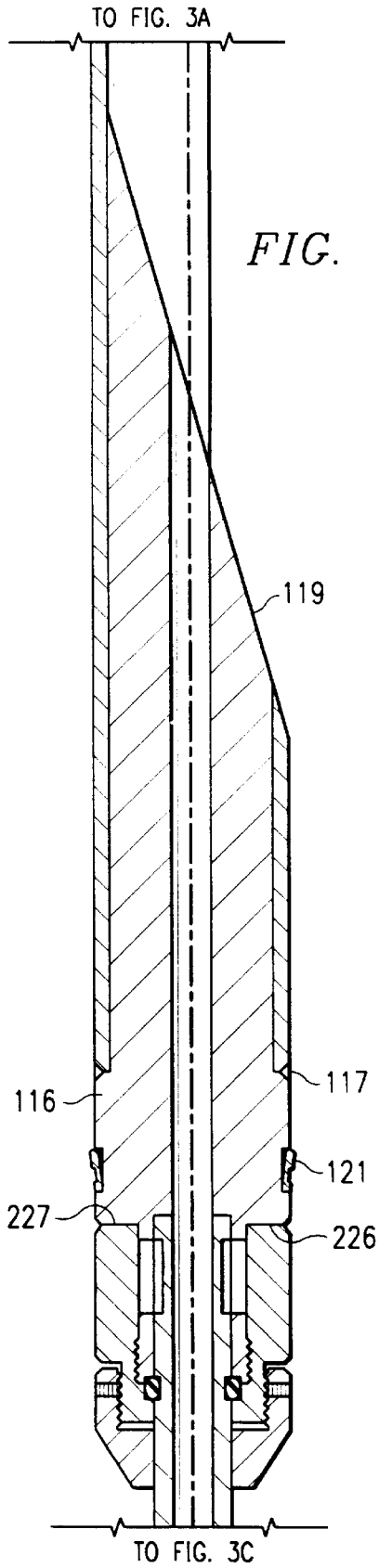
Figure 3C:
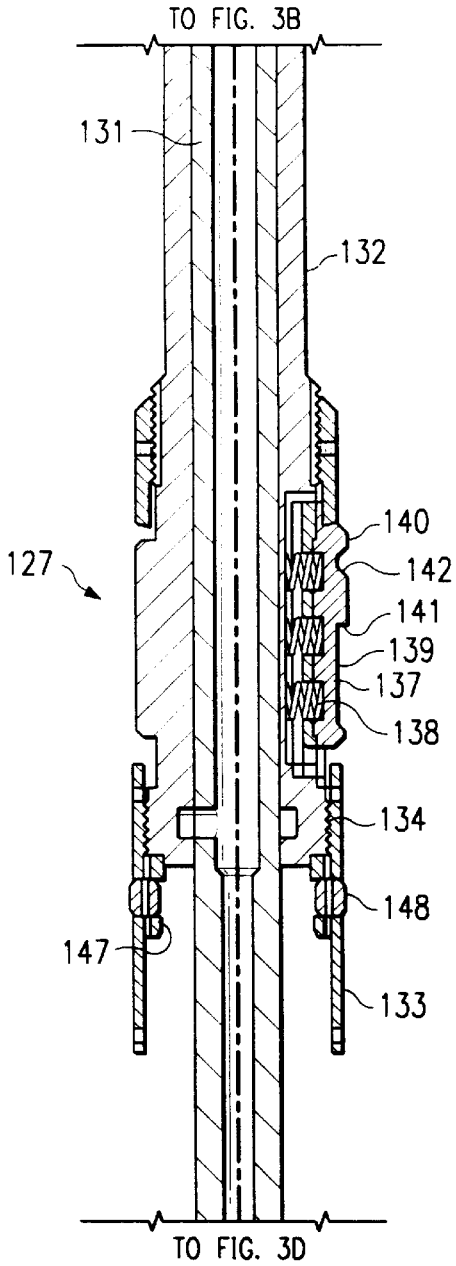
Figure 3D:
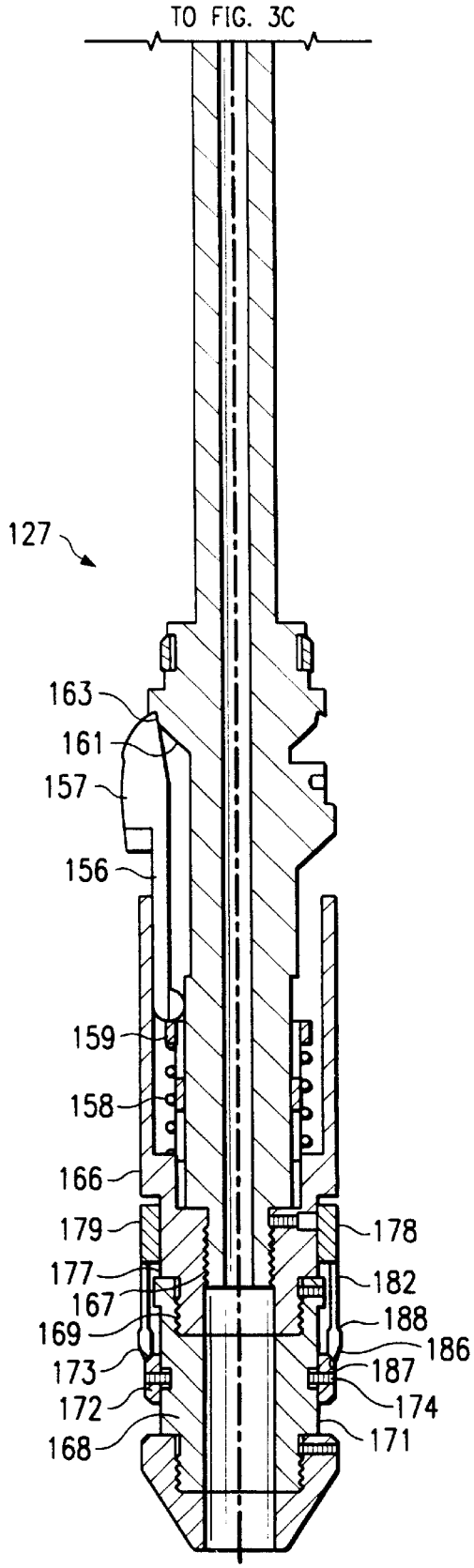

FIGS. 2A–2D, which are referred to collectively as FIG. 2, are respective portions of a diagrammatic cutaway side view of an auxiliary member 71 and a dimple connector 72. FIGS. 3A–3D, which are referred to collectively as FIG. 3, are respectively similar to FIGS. 2A–2D, in that they show the same structure, but in a different operational position.

Figure 4:
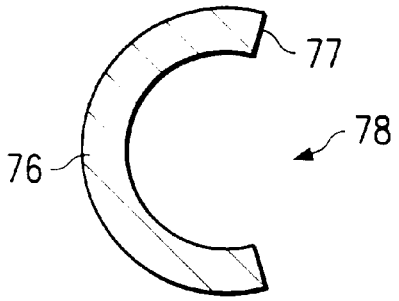
FIG. 4 is a diagrammatic sectional view taken along the line 4—4 in FIG. 2.

Referring to FIG. 2, the auxiliary member 71 is designed to be inserted vertically down through the inner casing 23 of FIG. 1, and thus has an outside diameter which is less than inside diameter of the tubing sections 51–55. The auxiliary member 71 includes an elongate vertical tube 76. The tube 76 has in one side thereof an axial slot 77, which extends most of the length of the tube 76, but which does not extend completely to either end of the tube 76. The interior of the tube 76 in the axial region of the slot 77 serves as a tool receiving region or recess 78. Due to the presence of the slot 77, the tube 76 has an approximately C-shaped cross section in the region of slot 77, as best seen in FIG. 4. A sleeve 81 is threadedly secured at 82 to the tubular upper end 80 of the tube 76, and a further sleeve 83 is threadedly secured at 84 to the upper end of the sleeve 81. A tubular closed-end collet 86 is disposed concentrically within the sleeve 81, and is free to rotate relative to sleeve 81. The collet 86 is held against axial movement in either direction with respect to the sleeve 81 by respective shoulders provided on the sleeves 81 and 83.

Figure 5:
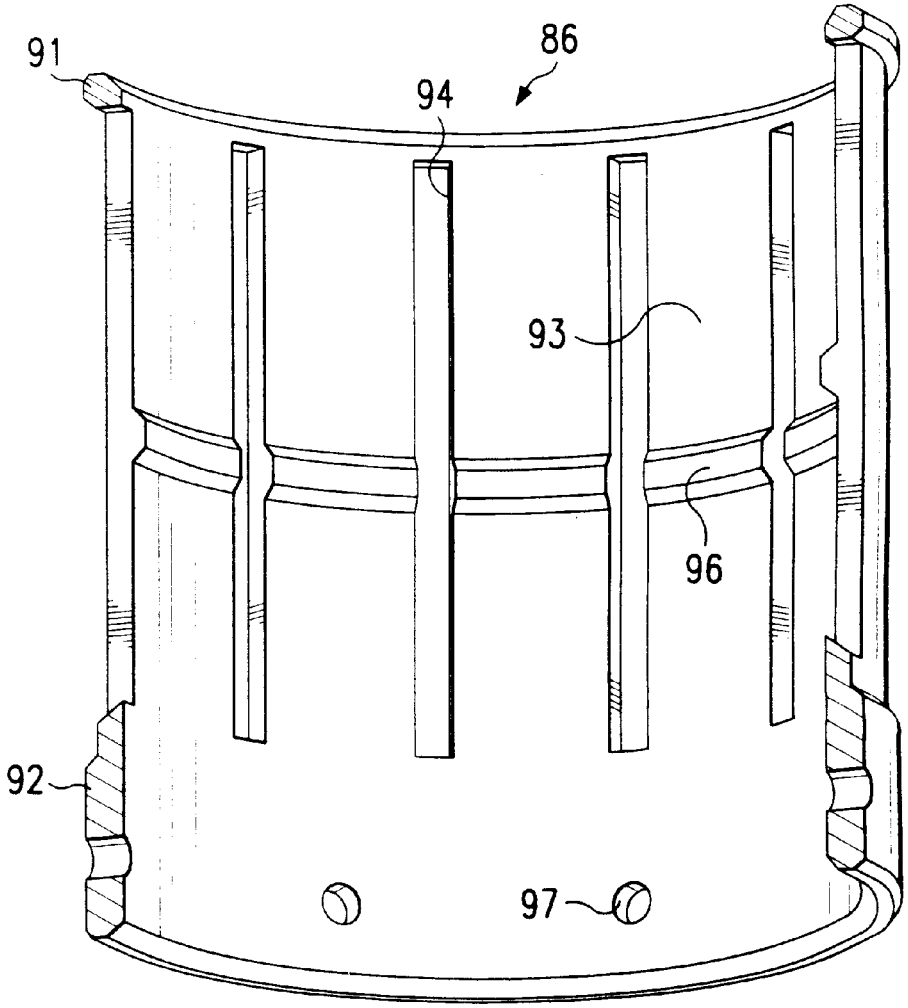
FIG. 5 is a diagrammatic cutaway perspective view of a closed-end collet which is a component of the auxiliary member of FIG. 2.
Figure 6A:
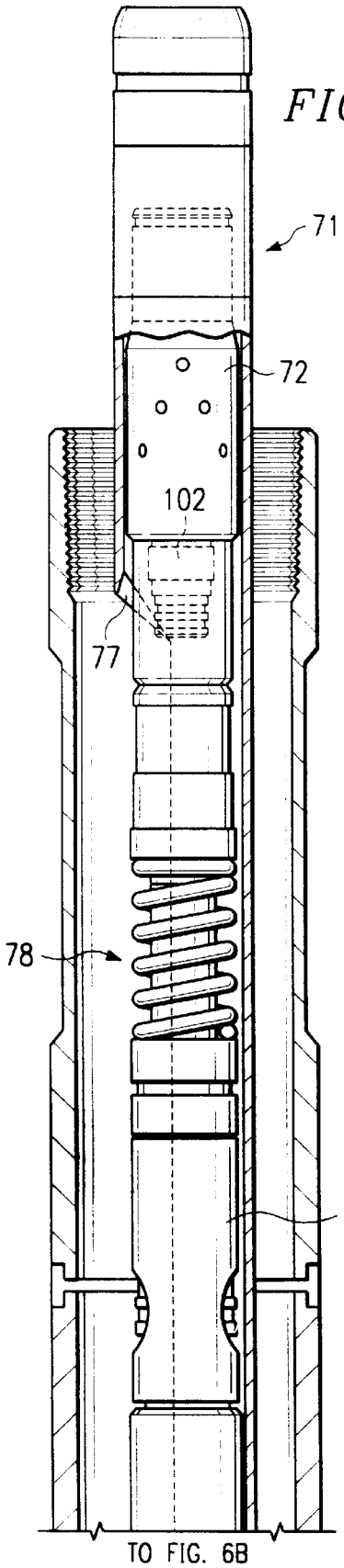
FIGS. 6A–6E are respective portions of a diagrammatic cutaway side view that shows the auxiliary member and the connector of FIG. 2 being inserted together with a tool into a portion of the well of FIG. 1, and are collectively referred to herein as FIG. 6.
Figure 6B:
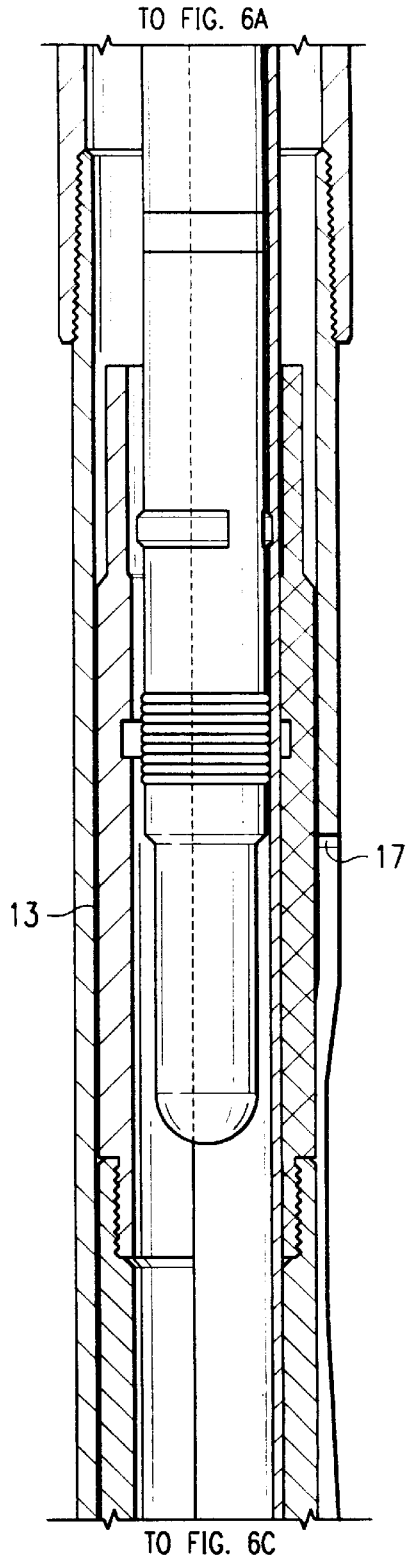
Figure 6C:
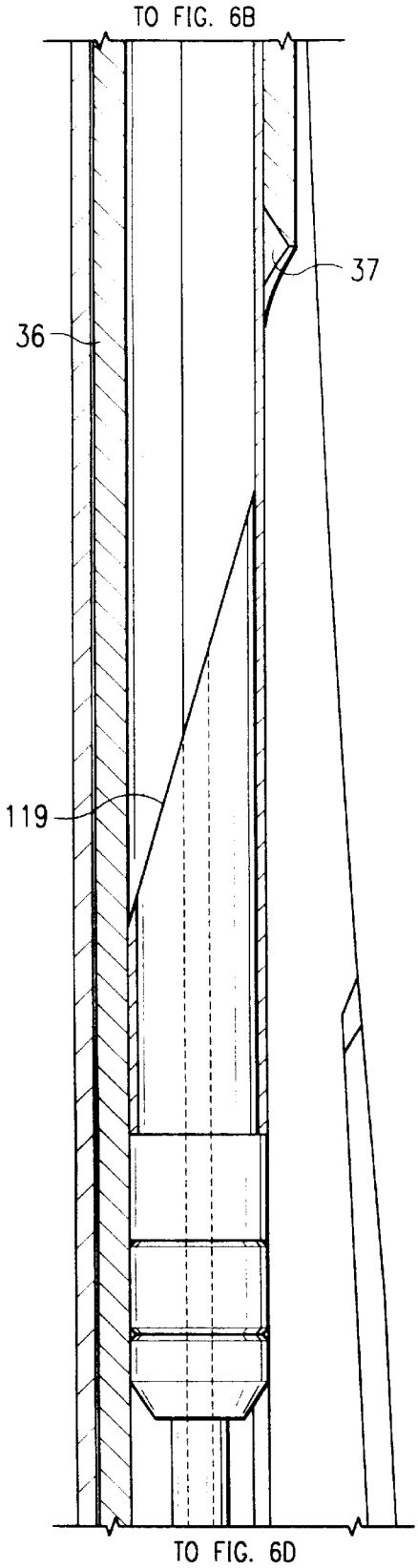
Figure 6D:
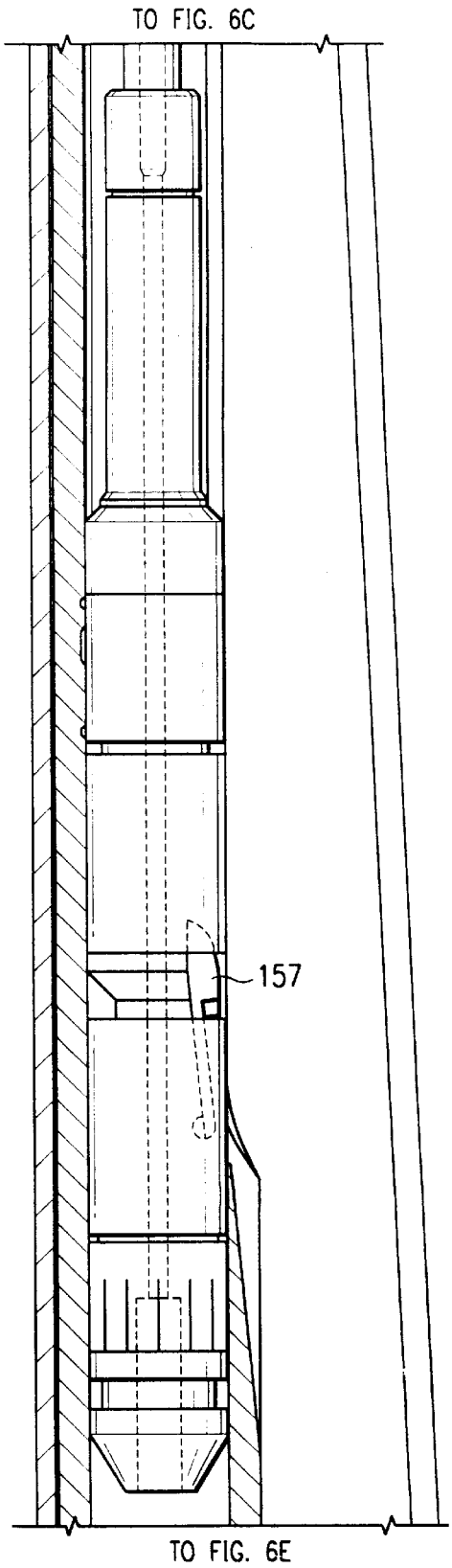
Figure 6E:
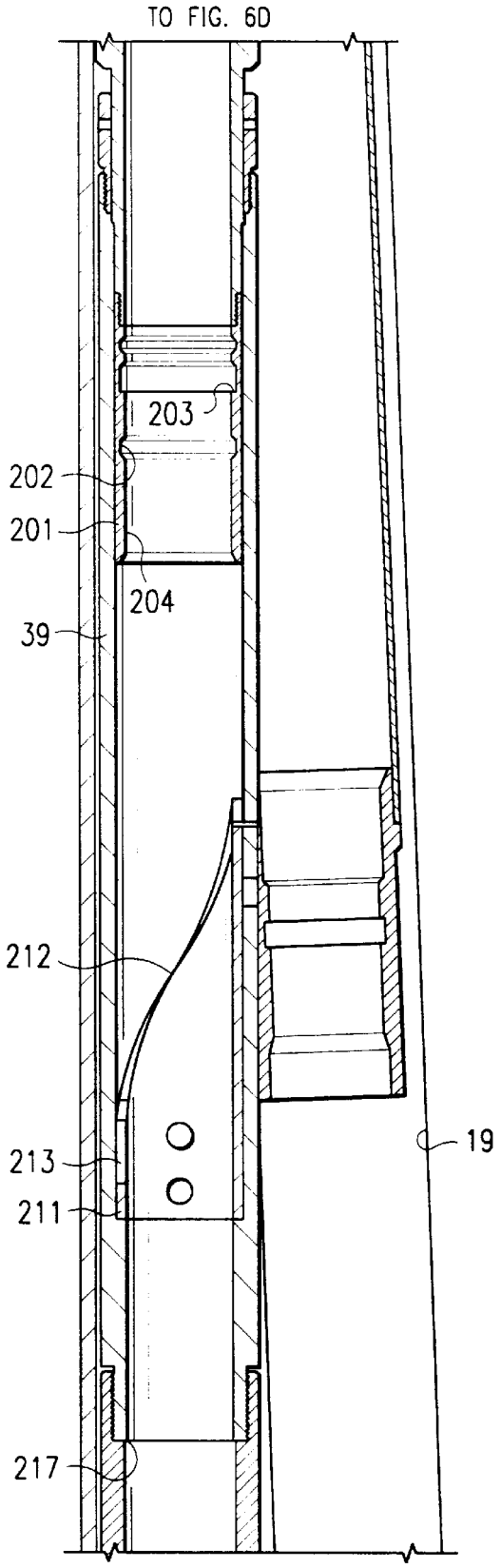
Figure 7A:
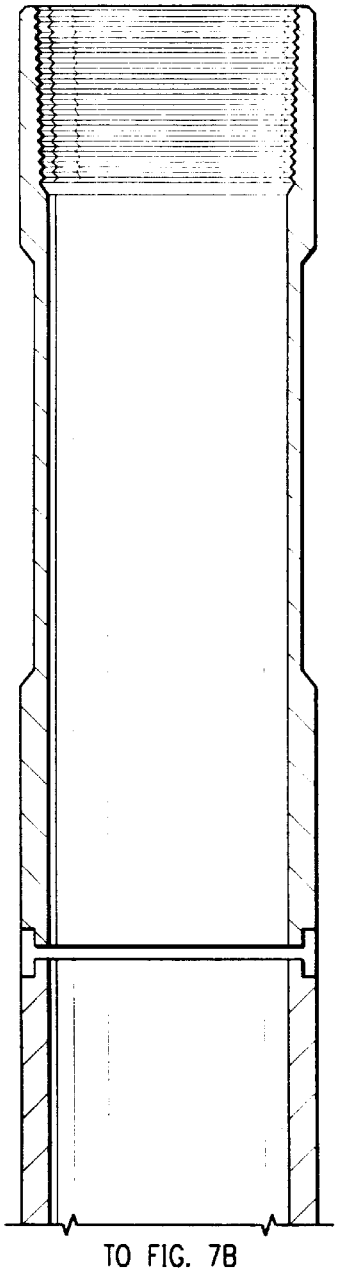
FIGS. 7A–7E are diagrammatic views similar to FIGS. 6A–6D, but show a different operational position of the illustrated structure, and are collectively referred to herein as FIG. 7.
Figure 7B:
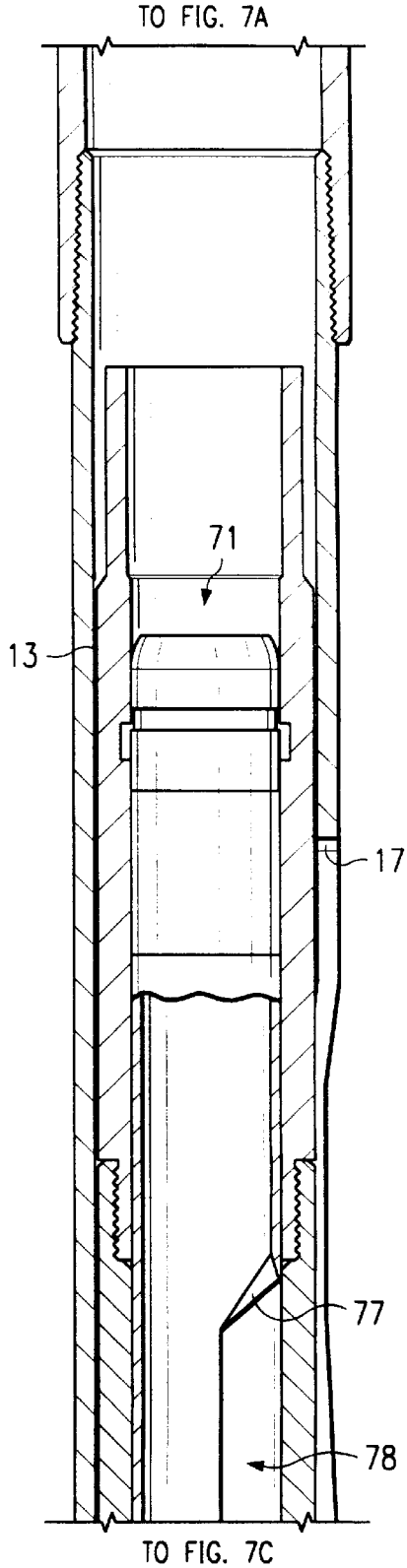
Figure 7C:
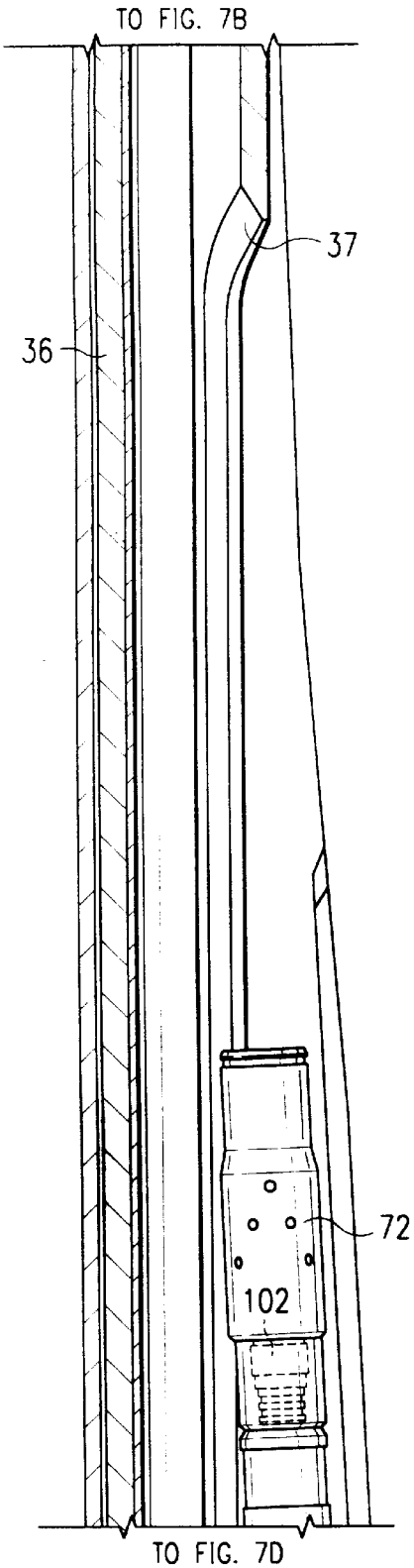
Figure 7D:
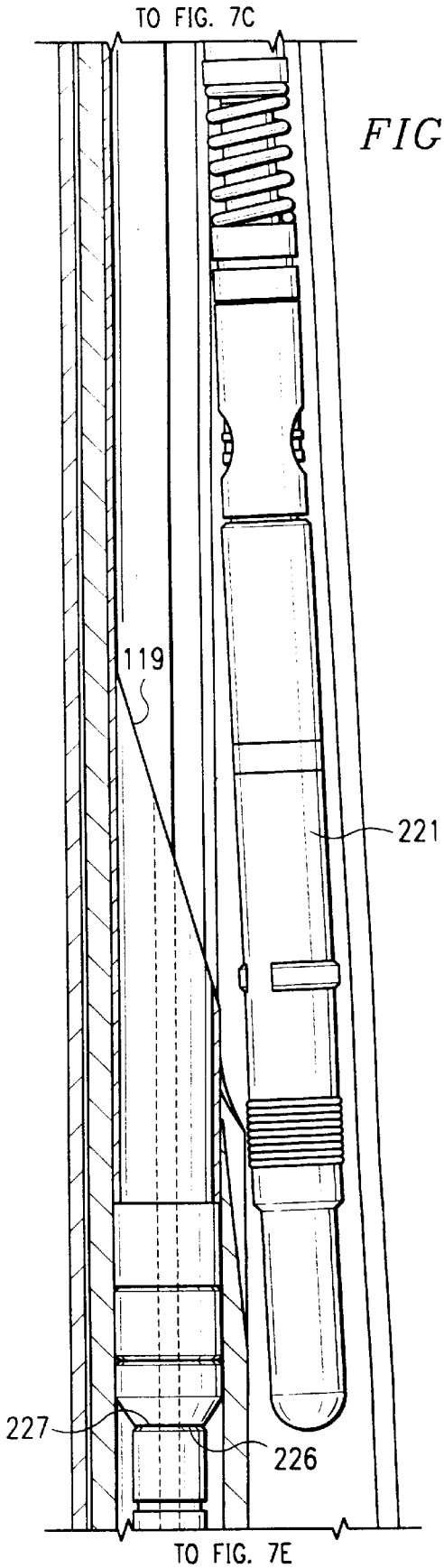
Figure 7E:
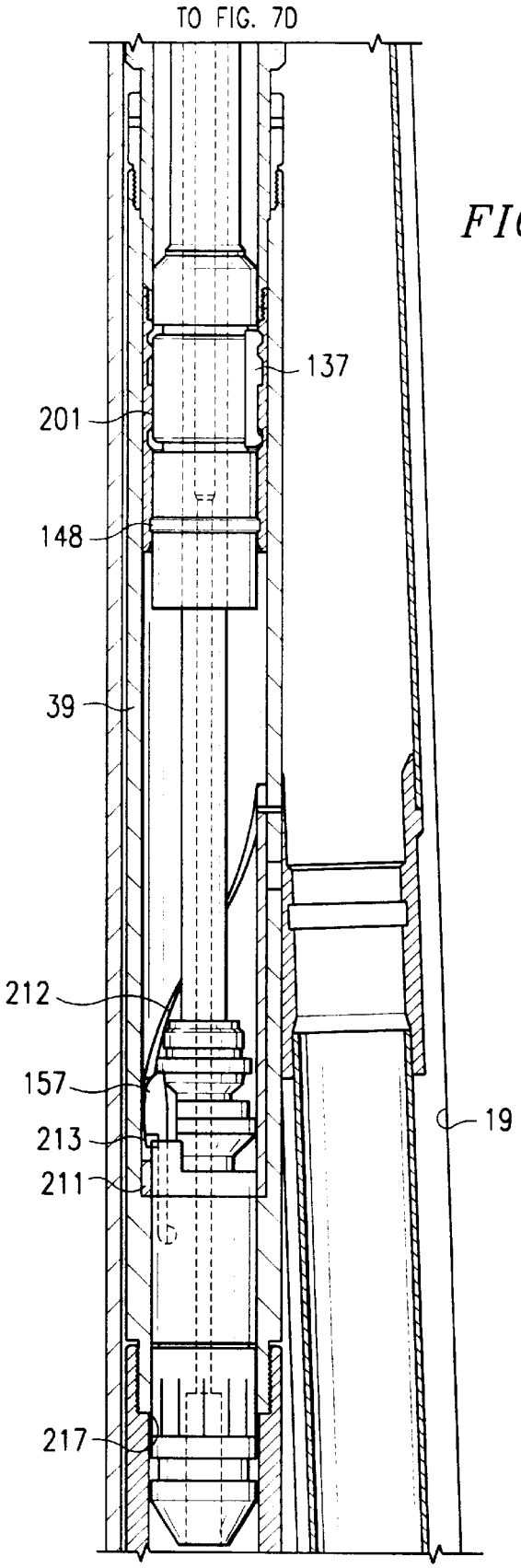

The details of the collet 86 may best be seen in FIG. 5. The collet 86 has unbroken annular end sections 91 and 92, which are connected by twelve axially extending fingers 93 defined by twelve axially extending slots 94. Each collet finger 93 has near the middle thereof a radially inwardly projecting boss 96. The fingers 93 can flex sufficiently so as to effect a limited amount of radial movement of the bosses 96 thereon. The lower annular end section 92 of the collet 86 has six circumferentially spaced openings 97 extending radially therethrough, for a purpose discussed below.

Referring to FIGS. 2 and 3, the dimple connector 72 has a plurality of threaded radial openings 101, which can each receive a respective not-illustrated setscrew in order to secure the dimple connector 72 in a known manner to a dimpled lower end section of a not-illustrated coiled tubing string. In particular, the inner end of each setscrew engages a respective dimple provided in the coiled tubing string. A tool stub 102 projects downwardly from the lower end of the dimple connector 72. A tool, which is not shown in FIGS. 2 and 3, may be fixedly secured to the tool stub 102.

The dimple connector 72 has at an upper end a circumferential groove 103, which is best seen in FIG. 3. Below this circumferential groove 103, the dimple connector 72 has six circumferentially spaced openings 104 that extend radially therethrough, one of which is shown in FIG. 3. With reference to FIG. 2, six shear pins 106 each have one end disposed in a respective one of the openings 97 in the collet, and the other end disposed in a respective one of the openings 104 in the dimple connector 72. The shear pins 106 thus secure the dimple connector 72 against rotational or axial movement with respect to the collet 86. However, as discussed above, the collet 86 is rotatable within the sleeve 81, and thus both the collet and the dimple connector 72 can rotate relative to the sleeve 81, even when they are secured to each other by the shear pins 106. The shear pins 106 serve as a locking or coupling arrangement, which prevents initial downward movement of the dimple connector 72 relative to the collet 86. The cooperation between the circumferential groove 103 and the bosses 96 on the collet 86 also resists initial downward movement of the dimple connector 72 relative to the collet 86. However, as discussed in more detail later, the pins 106 are eventually sheared during normal operation, and the bosses 96 disengage from the groove 103, so that the dimple connector 72 can move downwardly with respect to collet 86 through the relative operational position depicted in FIG. 3.

The dimple connector 72 has an annular bevel shoulder 108 thereon, which is capable of engagement with an annular bevel shoulder 109 provided on the sleeve 81. The dimple connector 72 cannot move upwardly with respect to the auxiliary member 71 beyond a position in which the shoulders 108 and 109 are engaging each other. When the dimple connector 72 is initially secured in place by the shear pins 106, the shoulders 108 and 109 may or may not be in engagement with each other. In the embodiment disclosed in FIGS. 2 and 3, the shoulders 108 and 109 are in engagement, or only have a very small space therebetween.

The auxiliary member 71 further includes a cylindrical deflector part 116, which is welded at 117 to the lower end of the tube 76, and which has a cylindrical portion projecting upwardly into the lower end of the tube 76. It will be recognized that the weld 117 could be replaced with some other suitable type of connection, such as cooperating threads. A deflector surface 119 is provided on the upper end of the deflector part 116. The deflector surface 119 is inclined at a steep angle with respect to the vertical, and is oriented to extend downwardly in a direction toward the slot 77. Stated differently, the surface 119 extends upwardly and inwardly from the lower end of the slot 77.

The deflector part 116 has near its lower end a circumferential groove, which has therein an annular debris barrier 121. The debris barrier 121 prevents debris within the inner casing 23 from moving downwardly around the exterior of the auxiliary member 71.

As discussed in more detail later, the deflector part 116 with the inclined deflection surface 119 thereon serves as a whipstock, and thus the auxiliary member 71 in the disclosed embodiment is a tubing exit whipstock (TEW). However, the present invention is also suitable for use with auxiliary members which do not have the deflector surface 119, as discussed later.

A selective orientation and locking device 127 is secured to and extends downwardly from the lower end of the deflector part 116. The device 127 includes a tubular shaft 131, which is secured to and extends downwardly from the lower end of deflector part 116. A tube 132 concentrically encircles the shaft 131, and is capable of axial sliding movement therealong. A sleeve 133 is secured by threads 134 to the lower end of the slidable tube 132, and also concentrically encircles the shaft 131. The tube 132 and sleeve 133 are capable of sliding axially on the shaft 131 between the positions respectively shown in FIGS. 2 and 3.

A selector key 137 is supported for radial movement on the upper end of sleeve 133, and is urged radially outwardly by several springs 138. The selector key 137 has on the radially outer side thereof a profile surface 139, which includes several protrusions that are vertically spaced, one of which is identified by reference numeral 140. The protrusions each have bevel surfaces on the upper and lower sides thereof, except for one protrusion which has a bevel surface 142 on the upper side thereof, but has a square, axially-facing shoulder 141 on the lower side thereof. The shoulder 141 is shown in the drawings as being square, but could alternatively have a small amount of negative inclination or rake, so that the shoulder 141 is slightly hook-like.

A C-shaped split ring 146 is disposed in an annular groove provided in the shaft 131. The walls of the groove prevent axial movement of the split ring 146 in either direction relative to shaft 131, regardless of whether the split ring 146 is relaxed or compressed. The sleeve 133 has thereon an upwardly facing annular shoulder 147 (FIG. 3). This shoulder 147, in the operational position shown in FIG. 2, engages the split ring 146 so that the split ring 146 prevents axial upward movement of the sleeve 133 and tube 132 relative to shaft 131. A plurality of circumferentially spaced release keys 148 are supported for radial movement with respect to the sleeve 133, within respective radial openings provided through the sleeve 133. When the device 127 enters a special narrow portion or controlled bore of the inner casing 23, as explained later, the walls of the inner casing press the keys 148 inwardly, and the keys 148 in turn press the split ring 146 radially inwardly to a compressed position in which the engagement between the split ring 146 and the shoulder 147 is interrupted, so that the split ring 146 no longer prevents upward movement of the sleeve 133 and tube 132 relative to the shaft 131.

With reference to FIG. 2, a plurality of circumferentially spaced shear pins 151 each extend radially between the sleeve 133 and the shaft 131. The shear pins 151 prevent downward movement of the shaft 131 relative to the sleeve 133 and the tube 132, until the pins 151 are sheared in a manner discussed later.

A lever 156 is disposed in a recess provided in one side of the shaft 131, and is capable of pivotal movement about its lower end between positions respectively shown in FIG. 2 and FIG. 3. The lever 156 has at an upper end thereof a radially outwardly projecting orientation lug 157. A helical compression spring 158 encircles the shaft 131, and urges a sleeve 159 upwardly, the sleeve 159 engaging the lower end of the lever 156.

When the sleeve 133 is in the operational position shown in FIG. 2, the lower end of sleeve 133 engages lug 157 and holds the lever 156 and lug 157 in a retracted position, which is shown in FIG. 2. When the shaft 131 moves downwardly relative to the sleeve 133, from the position shown in FIG. 2 to the position shown in FIG. 3, the spring 158 urges the sleeve 159 and lever 156 upwardly relative to the shaft 131, so that an inclined surface 161 on the shaft 131 pivots the lever 156 and moves the orientation lug 157 radially outwardly to the orientation position shown in FIG. 3. In the orientation position, the upper end of the lug 157 engages a surface 163, which prevents the lug 157 from moving radially inwardly away from its orientation position.

A sleeve 166 is secured by threads 167 to the lower end of shaft 131, and an extension 168 is secured by threads 179 to the sleeve 166. The extension 168 has thereon a radially outwardly facing cylindrical surface 171. A ring 172 concentrically encircles the surface 171, and has thereon an upwardly and outwardly facing annular bevel surface 173. The ring 172 is capable of axial sliding movement on the cylindrical surface 171, except that it is initially held against such movement by a plurality of circumferentially distributed shear pins 174, which each extend radially between the ring 172 and the extension 168.

The sleeve 166 has thereon a radially outwardly facing cylindrical surface 177. A collet 178 has an annular end section 179, which concentrically encircles the surface 177 and is axially slideable therealong. The collet 178 has a plurality of circumferentially distributed fingers 182 which extend downwardly from the end section 179, the fingers 182 being flexible so that the lower ends thereof are capable of limited radially movement. The lower end of each finger has three bevel surfaces thereon, including a downwardly and outwardly facing bevel surface 186, a downwardly and inwardly facing bevel surface 187, and an upwardly and outwardly facing bevel surface 188. The bevel surface 187 can engage the bevel surface 173 provided on the ring 172.

FIGS. 6A–6E, which are referred to collectively as FIG. 6, are respective portions of a diagrammatic sectional side view of the auxiliary member 71 as it is being inserted into the inner casing 23. FIGS. 7A–7E, which are referred to collectively as FIG. 7, are respective portions of a view similar to FIGS. 6A–6E but show a different operational position.

A portion of the inner casing 23 of FIG. 1 is shown in FIG. 6, and is the portion defined by the lateral access window system 36 and the alignment latch 39 at the lower end of window system 36. With reference to FIG. 6, the alignment latch 39 includes a mating sleeve 201, which is fixedly secured within the alignment latch 39. The sleeve 201 has thereon a radially inwardly facing profile surface 202, which includes a plurality of circumferential grooves or recesses, one of which is indicated at 202. Below the profile surface 202, the sleeve 201 has a radially inwardly facing cylindrical release surface 204.

Spaced below the sleeve 201, the alignment latch 39 includes an orientation sleeve 211, which is fixedly supported within the latch 39, and which has on an upper end thereof an upwardly facing helical surface 212. A short slot 213 is provided in the sleeve 211, and extends axially downwardly from the lower end of the helical surface 212. Below the sleeve 211, the alignment latch 39 includes a stationary, axially downwardly facing annular shoulder 217.

The inner structure of the alignment latch 29 (FIG. 1) is similar to that shown and described for the alignment latch 39, except that the particular profile surface in the latch 29 is different from the profile surface 202 in the latch 39.

In FIG. 6, the tool stub 102 of the dimple connector 72 has a tool 221 fixedly secured thereon. In FIG. 6, the tool 221 is a blanking plug, but virtually any other type of tool could be substituted for the tool 221, so long as it fits within the tool receiving recess 78 of the auxiliary member 71. In fact, the term "tool" is used herein to refer broadly to any type of useful device which may be attached to the tool stub 102.

The operation of the disclosed embodiment will now be briefly described. The auxiliary member 71 and the dimple connector 72 initially have the relationship shown in FIGS. 2 and 6, in which all shear pins are intact and the tool 221 is disposed within the tool receiving recess 78. The selector key 137 of the auxiliary member 71 is chosen to have a profile corresponding to either the profile surface 202 of the sleeve 201 in alignment latch 39, or the differing profile surface provided in the alignment latch 29, depending on whether the tool 221 is to be used in the lateral bore 19 or the lateral bore 18. For purposes of this explanation of system operation, it is assumed that the intent is to use tool 21 to perform work in the lateral bore 19, and that the selector key 137 therefore has a profile which matches the profile surface 202 in the alignment latch 39.

The assembly which includes the auxiliary member 71, the dimple connector 72 and the tool 221 is inserted into the upper end of the inner casing 23 of the well, with the dimple connector 72 fixedly connected to the dimpled lower end of a not-illustrated coiled tubing string. As the coiled tubing string is progressively run into the inner casing, this assembly is moved downwardly within the inner casing by the tubing string.

With reference to FIG. 2, as the auxiliary member 71 moves downwardly within the inner casing, the bevel surfaces 186 at the lower ends of the fingers 182 will guide the ends of the fingers past any obstructions, by flexing the lower ends of the fingers inwardly. The bevel surface 187 on each finger may slide inwardly and upwardly on the bevel surface 173 of the ring 172, which in turn may cause the collet 178 to temporarily slide upwardly a small distance on the surface 177, but after the obstruction has been passed the collet will slide back down to the position shown in FIG. 2.

When the auxiliary member 71 reaches the alignment latch 29, the profile surface on the selector key 137 will not match the profile surface on the mating sleeve in the alignment latch 29, and thus the selector key 137 will not be able to move radially outwardly under the urging of the springs 138. Consequently, the protrusions 140 on the selector key 137 will not be able to enter recesses in that mating sleeve, and in particular the square shoulder 141 will not be able to engage any surface in any recess of the mating sleeve. As a result, as the coiled tubing string continues to be run into the well, the assembly which includes auxiliary member 71 will continue downwardly past the alignment latch 29, and thus past the lateral bore 18.

Figure 8:
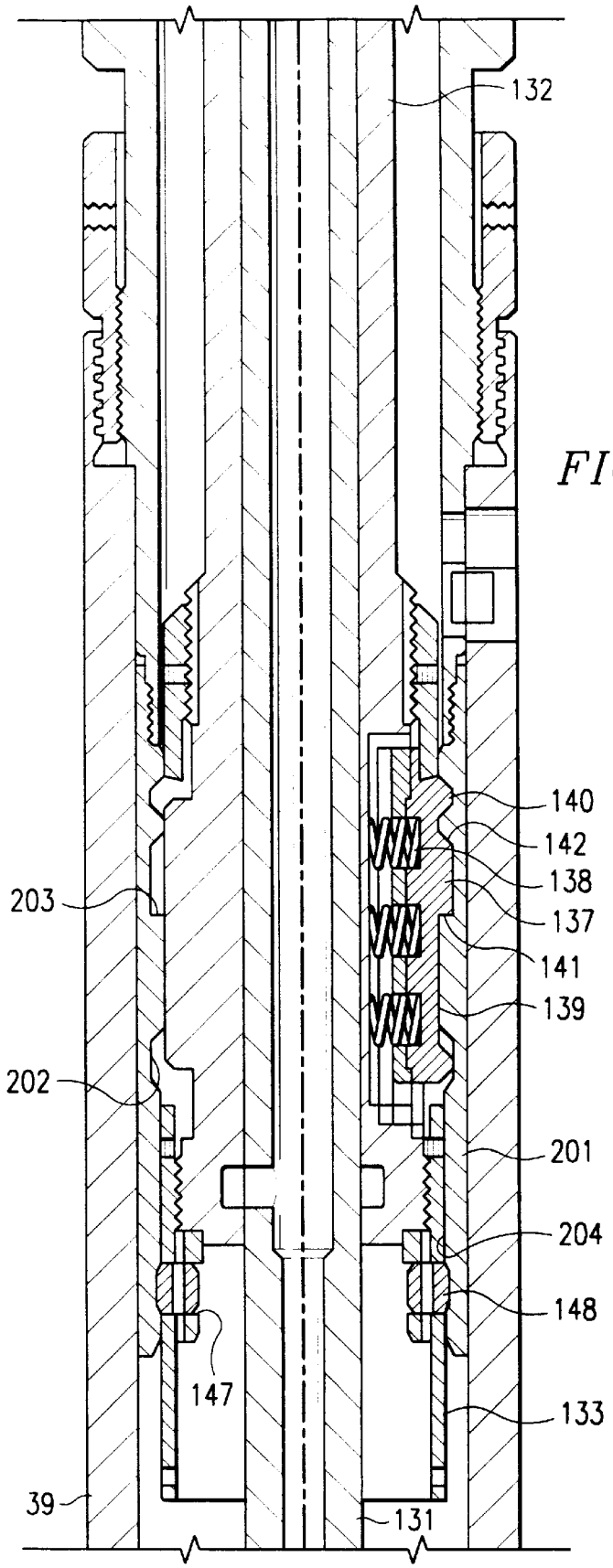
FIG. 8 is an enlarged view of a portion of FIG. 7.

When the auxiliary member 71 reaches the alignment latch 39, and when the selector key 137 becomes vertically aligned with the mating sleeve 201, the profile surface 139 on the selector key 137 will match the profile surface 202 on the sleeve 201, and the selector key 137 will move radially outwardly under the urging of the springs 138. This operational position of the selector key is shown in FIG. 7, and is also shown in FIG. 8, which is an enlarged view of a portion of FIG. 7. With reference to FIG. 8, the downwardly facing surface 141 on the selector key 137 will be engaging the upwardly facing annular surface 203 on the sleeve 201, thereby preventing further downward movement of the selector key 137 and the auxiliary member 71 relative to the stationary sleeve 201.

At the same time, the release keys 148 will all be pressed inwardly by the cylindrical release surface 204, and will compress the split ring 146 radially inwardly from its relaxed condition to its compressed condition, thereby interrupting the engagement of the split ring 146 with the annular shoulder 147 on sleeve 133. Thus, at this point, the engaging shoulders 141 and 203 will be preventing any further downward movement of the sleeve 133, but the split ring 146 will no longer be preventing downward movement of the shaft 131 relative to sleeve 133. Therefore, as the coiled tubing string continues to be run into the well, the downward force exerted on it from the surface will cause the shear pins 151 (FIG. 2) to shear, so that the shaft 131 can move downwardly relative to the sleeve 133, after which the orientation lug 157 is moved radially outwardly under the urging of the spring 158.

Figure 9:
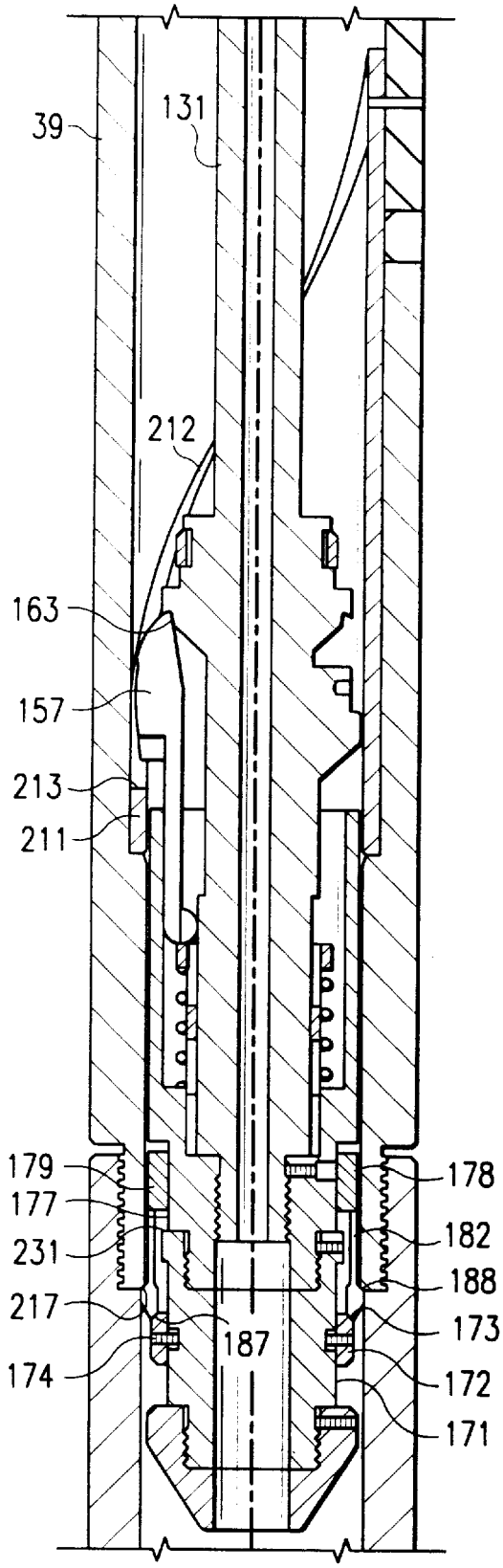
FIG. 9 is an enlarged view of a different portion of FIG. 7.

If the orientation lug 157 is rotationally aligned with the slot 213, the auxiliary member 71 will continue straight downwardly until the orientation lug 157 slides into the slot 213. However, this rotational alignment will typically not initially exist. For example, FIG. 6 shows a situation in which the orientation lug 157 is initially offset by 180° from the slot 213. In this situation, as the lug 157 and shaft 131 move downwardly, the lug 157 engages the helical surface 212 on the sleeve 211, and further downward movement of the shaft 131 causes the lug 157 to slide around the helical surface 212 while rotating the auxiliary member 71, until the lug 157 is aligned with and slides into the slot 213, as shown in FIG. 7. It will be noted that the entire auxiliary member 71 in FIG. 7 has been rotated 180° from the position shown in FIG. 6. The rotational movement of the auxiliary member is facilitated by the fact that the auxiliary member can rotate relative to the collet 86 secured by the shear pins 106 to the dimple connector 72, as discussed above with reference to FIG. 2. FIG. 9 is an enlarged view of a portion of FIG. 8, and shows the orientation lug 157 disposed within the slot 213.

The reason for effecting this rotational alignment is to ensure that the tool receiving recess 78 is rotationally oriented to face the window 37 in the inner casing, the window 17 in the outer casing, and the lateral bore 19. This also orients the inclined surface 119, so that it slants downwardly toward the lateral bore 19. In addition, the vertical position of the alignment latch 39 is selected so that the auxiliary member 71 will be positioned with the tool receiving recess 78 vertically aligned with the window 37 in the inner casing, and with the lateral bore 19.

When the shaft 131 reaches the operational position shown in FIGS. 7 and 9, the fingers 182 of collet 178 move outwardly so that the bevel surface 188 on each collet finger engages the annular shoulder 217 of the alignment latch 39. If an upward force were thereafter exerted on the shaft 131, the engagement of surfaces 188 and 217 would resist upward movement of the collet fingers 182, which in turn would prevent upward movement of the ring 172 and thus the shaft 131. The orientation of the bevel surface 173 on the ring 172, in cooperation with the bevel surfaces 187 on the collet fingers, urges the lower ends of the collet fingers radially outwardly, thereby maintaining the engagement between the surfaces 188 and 217. Thus, the auxiliary member 71 is held against inadvertent upward movement within the casing.

In the operational position shown in FIGS. 3 and 7, the surface 226 on a member secured to the lower end of the deflector part 116 has moved into engagement with an upwardly facing surface 227 at the upper end of the slideable tube 132. The tube 132 is, of course, held against downward movement within the casing by the engagement between shoulders 141 and 203 (FIG. 8). Thus, the deflector part 116 and the auxiliary member 71 are held against downward movement by the engaging surfaces 226 and 227. Consequently, as the coiled tubing string continues to be run into the well, the shear pins 106 (FIG. 2) will be sheared, the dimple connector 72 secured to the lower end of the coiled tubing string will begin to move downwardly relative to the auxiliary member 71, and the groove 103 (FIG. 3) at the upper end of the dimple connector 72 will move out of engagement with the bosses 96 on the fingers 93 of the collet 86. As the coiled tubing string moves the dimple connector 72 and the tool 221 downwardly, the lower end of the tool 221 will engage the inclined deflector surface 119, and will be deflected laterally outwardly into the lateral bore 19 through the windows 37 and 17. As the coiled tubing string continues to be run into the well, the dimple connector 72 and the tool 221 thereon will move further into the lateral bore 19. When the tool is in an appropriate position within the lateral bore 19, insertion of the coiled tubing string into the well is halted. The tool 221 can then be utilized in an appropriate manner, depending on its function.

When it is desired to remove the tool 221 from the well, along with the auxiliary member 71, upward movement of the coiled tubing string is initiated at the upper end of the well. This retracts the dimple connector 72 and the tool 221 back out of the lateral bore 19, until the dimple connector 72 moves back up into the upper end of the auxiliary member 71, so that the bevel shoulder 108 on the dimple connector 72 engages the bevel shoulder 109 on the auxiliary member 71. At this point, the tool 221 on the dimple connector 72 will have moved back into the tool receiving recess 78 of the auxiliary member 71. Further, the bosses 96 on the fingers of the collet 86 will be engaging the circumferential groove 103 on the dimple connector 72, to resist downward movement of the tubing string and dimple connector 72 relative to the collet 86 on the auxiliary member 71. Since the engagement of the shoulders 108 and 109 prevents further upward movement of the dimple connector 72 relative to the auxiliary member 71, the upward force exerted on the coiled tubing string from the upper end of the well will be transferred to the auxiliary member 71 through the dimple connector 72. As discussed above, and with reference to FIG. 9, upward movement of the auxiliary member 71 is inhibited by engagement of the lower ends of the collet fingers 182 with the surfaces 217 and 173. Consequently, the upward force exerted on the auxiliary member 71 by the tubing string will cause the shear pins 174 to shear, thereby permitting the ring 172 to slide downwardly along the cylindrical surface 171. This permits the shaft 131 of the auxiliary member 71 to start to move upwardly. As this occurs, the collet 178 will remain stationary and will slide downwardly along the cylindrical surface 177, until the end section 179 of the collet engages an annular shoulder 231 which is fixedly disposed on the shaft 131. The position of the shoulder 231 is selected so that the collet 178 cannot travel downwardly as much as the ring 172. Consequently, when the collet engages the shoulder 231, the lower ends of the collet fingers 182 will be spaced above the ring 172, and cooperation between the bevel surfaces 188 and 217 will cause the collet fingers to flex inwardly, so that the shaft 131 and the collet 178 will move upwardly together with the auxiliary member 71. As the coiled tubing string continues to be withdrawn from the well, the auxiliary member 71, the dimpled sleeve 72 and the tool 221 will all be withdrawn together from the well.

In a variation of the disclosed embodiment, the axial slot 77 in the auxiliary member 71 could be omitted, the inclined deflection surface 119 could be omitted, the shaft 131 could have a larger outside diameter, and a larger central bore could be provided through the member 116 and the shaft 131. The connector 72 could optionally be smaller. Then, after the locking device 127 engaged one of the latches 29 or 39 in order to vertically secure the modified auxiliary member 71 within the casing, the connector 72 and tool 221 could move vertically downwardly through the lower end of the modified auxiliary member 71 and into the vertical casing. This would be particularly useful for using relatively small tools at the bottom of the vertical casing, especially a tool which is smaller than the windows to the lateral bores 18 and 19, and which might inadvertently slip through one of these windows and go into a lateral bore when the intent was to insert that tool downwardly within the vertical casing. The modified tube 76, without slot 77, would be larger than the windows, and would prevent the small tool from inadvertently slipping into a lateral bore until it had passed all intervening lateral bores. The tool 221, the connector 72 and the modified auxiliary member 71 would be withdrawn from the well in a manner similar to that described above.

Although two embodiments have been disclosed in detail, it will be understood that various changes, substitutions and alterations can be made therein, including the rearrangement and reversal of parts, without departing from the spirit and scope of the present invention as defined by the following claims.

What is claimed is:

1. A system for guiding a first tubular string from a first wellbore into a second wellbore intersecting the first wellbore, the system comprising:

a second tubular string positioned within casing lining the first wellbore, the second tubular string including a window formed through a sidewall thereof, the window being oriented toward the second wellbore;

the first tubular string being received within the second tubular string; and a deflection device releasably securable to the first tubular string and releasably securable to the second tubular string, the deflection device being aligned with the window by engagement between an alignment profile of the second tubular string and an alignment member attached to the deflection device, the alignment member being maintained in a retracted position thereof spaced apart from the second tubular string until the deflection device is received within the second tubular string proximate the window.

2. The system according to claim 1, wherein the second tubular string further includes a latching device, the latching device releasably securing the deflection device to the second tubular string.

3. The system according to claim 1, wherein the second tubular string further includes a generally tubular assembly interconnected therein, the window being formed through a sidewall of the assembly, and wherein the deflection device is aligned with the window and releasably secured relative to the assembly when the deflection device is operatively received within the assembly.

4. The system according to claim 1, wherein the second tubular string further includes a generally tubular assembly interconnected therein, the window being formed through a sidewall of the assembly, and wherein the deflection device is released from securement to the first tubular string and deflects the first tubular string through the window and into the second wellbore when the deflection device is operatively received within the assembly and the first tubular string is displaced axially relative to the second tubular string.

5. A system for guiding a first tubular string from a main wellbore into a selected one of multiple branch wellbores intersecting the main wellbore, the system comprising:

a second tubular string positioned within the main wellbore, the second tubular string including multiple axially spaced apart generally tubular assemblies interconnected therein, each of the assemblies having a window formed through a sidewall thereof, each of the windows being oriented toward one of the branch wellbores, and each of the assemblies further having a latch device; and the first tubular string being received within the second tubular string and having a deflection device and a selective latch device releasably secured thereto, the first tubular string selective latch device releasably securing the deflection device to a selected one of the assembly latch devices, and preventing securement of the deflection device to unselected ones of the assembly latch devices, when the first tubular string is conveyed through the second tubular string.

6. The system according to claim 5, wherein each of the assembly latch devices is an internal profile, one of the internal profiles being cooperatively shaped relative to the first tubular string selective latch device, so that the first tubular string latch device engages the cooperatively shaped internal profile when the first tubular string is conveyed through the second tubular string.

7. The system according to claim 6, wherein each of the assemblies includes an alignment device, the alignment device of the assembly which includes the cooperatively shaped internal profile aligning the deflection device with the window in response to the first tubular string selective latch device engaging the cooperatively shaped internal profile.

8. A method of guiding a first tubular string from a first wellbore into a second wellbore intersecting the first wellbore, the method comprising the steps of:

positioning a second tubular string within casing lining the first wellbore, the second tubular string including a window formed through a sidewall thereof, and the window being oriented toward the second wellbore;

conveying the first tubular string into the second tubular string, the first tubular string having a deflection device releasably secured thereto;

engaging an alignment member attached to the deflection device with an alignment profile of the second tubular string, thereby aligning the deflection device with the window, the alignment member being released for engagement with the alignment profile only when the deflection device is proximate the window, and the alignment member being spaced apart from the second tubular string until the deflection device is proximate the window;

releasably securing the deflection device to the second tubular string;

releasing the deflection device from the first tubular string; and deflecting the first tubular string off of the deflection device and into the second wellbore.

9. The method according to claim 8, wherein the releasably securing step further comprises engaging a first latch device of the first tubular string with a second latch device of the second tubular string.

10. The method according to claim 9, wherein the releasing step further comprises displacing the first tubular string relative to the deflection device after engagement of the first and second latch devices.

11. The method according to claim 8, wherein the engaging step is performed in response to performance of the releasably securing step.

12. The method according to claim 8, further comprising the steps of withdrawing the first tubular string from the second wellbore, and retrieving the first tubular string from the first wellbore along with the deflection device.

13. The method according to claim 8, wherein in the releasing step, the first tubular string remains reciprocably received within a portion of the deflection device after the deflection device is released from the first tubular string.

14. A method of guiding a first tubular string from a main wellbore into a selected one of multiple branch wellbores intersecting the main wellbore, the method comprising the steps of:

positioning a second tubular string within the main wellbore, the second tubular string including multiple spaced apart assemblies interconnected therein, each of the assemblies having a window formed through a sidewall thereof, and each of the windows being oriented toward one of the branch wellbores;

inserting the first tubular string into the second tubular string, the first tubular string having a deflection device and a selective latching device releasably attached thereto;

engaging the selective latching device with a selected one of the assemblies, thereby selecting one of the branch wellbores for insertion of the first tubular string therein and preventing the first tubular string from being inserted into any branch wellbore other than the selected one of the branch wellbores; and deflecting the first tubular string off of the deflection device and into the selected branch wellbore.

15. The method according to claim 14, wherein the engaging step further comprises engaging the selective latching device with a cooperatively shaped latching device of the selected assembly.

16. The method according to claim 14, wherein the engaging step further comprises engaging an alignment device of the selected assembly with the first tubular string, thereby aligning the deflection device with the window of the selected assembly.

17. The method according to claim 14, wherein the engaging step further comprises releasing the deflection device from the first tubular string and releasably attaching the deflection device to the second tubular string.

18. The method according to claim 14, further comprising the step of withdrawing the first tubular string from the branch wellbore and retrieving the first tubular string from the second tubular string along with the deflection device.

* * * * *